US007451757B2

(12) United States Patent
Ketterhagen et al.

(10) Patent No.: US 7,451,757 B2
(45) Date of Patent: Nov. 18, 2008

(54) CONCRETE CUTTER

(76) Inventors: Frederick A. Ketterhagen, 5475 Highway 36, Burlington, WI (US) 53105; Kevin F. Ketterhagen, 5475 Highway 36, Burlington, WI (US) 53105; Anthony J. Mertes, 9124 Dakota La., Chanhassen, MN (US) 55317; Gary L. Barger, 16509 140 St., Foreston, MN (US) 56330

( * ) Notice: Subject to any disclaimer, the term of this patent is extended or adjusted under 35 U.S.C. 154(b) by 0 days.

(21) Appl. No.: 11/682,453

(22) Filed: Mar. 6, 2007

(65) Prior Publication Data

US 2007/0209651 A1 Sep. 13, 2007

Related U.S. Application Data

(60) Provisional application No. 60/779,749, filed on Mar. 7, 2006.

(51) Int. Cl.
*B28D 1/04* (2006.01)

(52) U.S. Cl. ..... 125/13.01; 299/39.3

(58) Field of Classification Search ..... 125/13.01, 125/13.03, 14, 38, 3, 4, 5; 451/350, 352, 451/353; 299/39.3, 75
See application file for complete search history.

(56) References Cited

U.S. PATENT DOCUMENTS

| | | | | |
|---|---|---|---|---|
| 3,649,071 | A * | 3/1972 | Graff | 299/41.1 |
| 4,433,871 | A * | 2/1984 | Bertrand | 299/41.1 |
| 4,792,190 | A * | 12/1988 | Bertrand | 299/41.1 |
| 4,832,412 | A * | 5/1989 | Bertrand | 299/39.3 |
| 4,836,494 | A * | 6/1989 | Johnsen | 248/669 |
| 5,044,696 | A * | 9/1991 | Blackhurst | 299/41.1 |
| 5,676,125 | A * | 10/1997 | Kelly et al. | 125/13.03 |
| 6,582,026 | B2 * | 6/2003 | Bertrand | 299/39.3 |

* cited by examiner

*Primary Examiner*—Robert Rose
(74) *Attorney, Agent, or Firm*—Joseph S. Heino; Patrick M. Bergin

(57) ABSTRACT

An improved concrete cutter has a longitudinally-extending primary boom and one or more saw carriage sub-assemblies that move along the length of the boom. "Wing-like" boom extensions are hingedly secured at each end of the primary boom. The boom extensions can be easily positioned at each end of the primary boom to extend the cutting width of the concrete cutter and without requiring removal of the boom extensions from the concrete cutter. The saw carriage sub-assemblies are independently movable along the boom extensions. Carriage spacing is variably-adjustable along the boom such that each saw carriage can move toward or away from the other saw carriage. Each saw carriage sub-assembly is height-variable and is self-adjusting to contours in the profile of the concrete surface being cut.

6 Claims, 5 Drawing Sheets

CONCRETE CUTTER

This application claims the benefit and priority of U.S. Provisional Patent Application Ser. No. 60/779,749 filed Mar. 7, 2006.

FIELD OF THE INVENTION

This invention relates generally to saws and to sawing equipment of the type used for cutting grooves into material such as concrete pavement and the like. More particularly, this invention relates to an improved concrete cutter of the riding type that serves as a vehicle for the operator, the improved concrete cutter having a novel boom and concrete cutting carriage sub-assembly for enhanced cutting capabilities and performance.

BACKGROUND OF THE INVENTION

The present inventors are aware of prior art that provides various motor-driven or powered saws for cutting grooves into materials such as concrete pavement and the like. Indeed, this is old art. Grooves are most commonly cut in concrete pavement and related materials by such saws as a means for controlling the cracking of such materials, particularly in areas where wide seasonal temperature variations result in the concrete pavement being susceptible to cracking due to thermal expansion and contraction. In order to control this type of cracking, which cracking otherwise tends to be random and unsightly and also tends to weaken the pavement, grooves are cut in the surface of the pavement.

Concrete saws or cutters that are incorporated into some sort of vehicle that allows an operator to ride the vehicle during the cutting process are also known in the art. For example, riding concrete saws or cutters, also called "span saws" in the art, are disclosed and claimed in U.S. Pat. No. 5,724,956 issued to Ketterhagen and in U.S. Pat. No. 6,470,874 issued to Mertes. In their most basic form, such riding concrete cutters can be said to include certain common elements. For example, the riding concrete cutters of prior construction include a chassis that is movable upon a concrete surface, a cutting sub-assembly that is supported by the chassis, the cutting sub-assembly including a saw blade, a drive means for actuating the cutting sub-assembly, an operator platform that includes an operator seat, and an operator control means, such means being used by the operator to control and maneuver the chassis and the cutting sub-assembly over the concrete surface.

While such riding concrete saws are useful and beneficial for their intended purpose, these inventors have come to appreciate that there is a need to improve over this prior art in such a way that will enhance operation and improve the speed at which such concrete saws operate. For example, most prior art span saws had the sawing carriages, or cutter heads, connected together by means of a mechanical link so that the heads would move in unison. The obvious disadvantage of this arrangement is that the operator had to determine the correct head spacing and then manually attach or adjust a spacer bar for each specific sawing application. After sawing a few joints, the operator would then see if each head was sawing the same amount of concrete to insure that the blade wear was equal for each head and to maximize the sawing time. If they were not equal, then the operator would need to re-adjust the heads accordingly.

Another shortcoming in the span saws of the prior art was due to the fact that such span saws used booms that are completely mechanically attached to one another, and to the required width for the particular job at hand. If the job called for 24 foot (24') cut and the saw had been set up previously for a 32 foot (32') cut, then boom sections would be removed and stored away. If it was a large job that required weeks of sawing, often times the booms would be left behind when moving the span saw itself to the next job site or they would be damaged while in storage. Even if boom sections were not misplaced, the span saw may have traveled many miles down the road before completion and the booms would need to be tracked down to the location where they had been removed in the first instance. Furthermore, the boom sections tended to be matched to fit to one side or the other of the span saw, which could result in the boom sections being mixed up when they were being re-attached or re-installed for another job. Sometimes, the boom sections would be stored for a season or two, depending upon what type of slab width the contractor is required to cut, further increasing the risk that boom sections could be lost or misplaced.

Another disadvantage of the span saws of the prior art is that, in order to transport a span saw with its booms attached, a very long trailer would be required to accommodate the full width of the saw. Even with the booms attached in this fashion, they would also be vulnerable to damage since they tend to hang out very far from the main frame of the span saw.

Another disadvantage of the span saws of the prior art is that ground clearance was typically a problem, particularly when saws were transported from slab to slab. With the carriages positioned anywhere along the boom or boom sections, the entire boom needs to be elevated in order to move the span saw forwardly or rearwardly. Furthermore, extra long ramps have to be built to prevent the carriages from dragging on the ground. It is also difficult to load these units onto trailers without an extra long ramp.

The bottom line is that the span saws of the prior art, in the view of these inventors, create major problems that are related to both a lack of mobility and an inability to provide for quick set-up. As an aside, these inventors have also come to appreciate that there is a need to collect the by-products of concrete cutting during the sawing process, such by-products including potentially harmful elements that are a natural result of saw degradation and wear. That is, as the concrete saw blade is used, it also wears down, thereby distributing fine elemental contaminants at the point of cutting. These elements are best contained and prevented from being placed into the environment by capture through a slurry process. The slurry process uses a supply of water or other fluid to lubricate and cool the saw blade during cutting and to control the concrete dust that is creating during the cutting process.

In view of the foregoing, the present inventors have devised an improved riding concrete cutter that has a novel boom and carriage sub-assembly where at least two sawing blades are used to cut a single groove. This boom and carriage sub-assembly arrangement improves over prior art by replacing a forwardly-disposed boom used in riding concrete cutters of prior art with a much improved boom and saw carriage sub-assembly. A boom of this prior art type is more particularly illustrated in phantom view in U.S. Pat. No. D470,157 issued to Ketterhagen et al., which patent is drawn to a design for a concrete cutter frame and cab. As shown, the frame of that design includes a forwardly-disposed boom, the boom being disposed in a position that is transverse to the travel path of the riding concrete cutter. Use of this type of prior art concrete cutter begins as the concrete cutter is advanced to a position along a portion of a concrete slab at which a groove is to be cut. The cutter is then temporarily parked and two saws that are longitudinally-movable along the boom travel along the boom to cut a transverse groove in the concrete slab. In the prior art, it would be typical to mount the two saws in a fixed, spaced-apart relationship. The saw blades would be rotatably-actuated and positioned such that, when both saws and their saw blades are lowered, a first saw and its first saw blade are positioned just outside of the edge of the concrete slab and a second saw and its saw blade are positioned above the slab and begins to cut into it, thereby forming part of a groove at that point. The two saws are then further actuated to move longitudinally along the boom and transversely along the slab. The first saw blade cuts into the slab edge and forms another part of the groove beginning at that point. As the two saws and their respective blades continue to move along the slab, the groove that is being formed by the first saw blade eventually joins the groove that was cut by the second saw blade, the first saw blade essentially traveling behind the second saw blade but fully aligned with it. With some overlapping, a complete groove is cut. When the groove is completed, the saws can be retracted upwardly and concrete cutter advanced to the place where the next transverse groove needs to be cut, and so on.

With this configuration, it can be appreciated that there is little flexibility with the relative position of the two saws along the boom. There is also no flexibility with the relative position of the saws and the concrete surface. For example, there is little if any flexibility for the configuration of the prior art to adjust for "crowns" in the concrete that is being cut. Rather than adjusting for such crowns, one carriage and blade will tend to simply cut more deeply than the other, resulting in excessive or uneven wear of the concrete-cutting blades that are used. Further, and in order to expand the cutting width of the concrete cutter, additional boom sections must be manually attached to the existing boom. As discussed earlier, this leads to problems in proper attachment of the additional boom sections to the primary boom, misalignment of the added boom section and possible malfunctioning of the saws, and a risk of the loss or misplacement of the additional boom sections as the machine is moved between work sites and during storage in the off-season.

In the view of these inventors, there is a need to provide an improved concrete cutter having a boom and saw carriage sub-assembly that overcomes all of the foregoing disadvantages. What is needed is an improved concrete cutter having such a boom and saw carriage assembly where boom extensions are integrated with the primary boom and available for use when such is desired or required by the operator. What is also needed is such an improved concrete cutter having such a boom and saw carriage sub-assembly where saw carriage alignment and spacing is variably-adjustable along the boom. What is also needed is such an improved concrete cutter where the boom and saw carriage sub-assembly is height-variable for each saw carriage and where each saw carriage is operable independently of the other saw carriage, or carriages, used in the assembly such that the assembly automatically adjusts for contours in the profile of the concrete slab that is being cut. What is also needed is an improved concrete cutter that allows the carriage sub-assemblies to be moved towards the outer portion of a boom, whereby the boom and carriage sub-assembly can be rotated upwardly to allow for clearance of the concrete cutter during transport and movement between sites and between cuts. What is also needed is an improved concrete cutter where the boom assembly also provides a primary structural support member for the chassis of the concrete cutter. What is also needed is an improved concrete cutter having an optional vacuum system for the collection and accumulation of concrete-dust and contaminant slurry as a groove is being cut in the concrete slab.

SUMMARY OF THE INVENTION

It is, therefore, a principal object of this invention to provide a new and useful improved concrete cutter that has a boom and saw carriage sub-assembly where boom extensions are integrated with the primary boom and available for use when such is desired or required by the operator. It is another object to provide an improved concrete cutter having such a boom and saw carriage sub-assembly where saw carriage alignment and spacing is variably-adjustable along the boom. It is still another object to provide such an improved concrete cutter where each saw carriage is independently movable of the other saw carriage used in the sub-assembly and where the boom and saw carriage sub-assembly is height-variable for each saw carriage and where such that the sub-assembly automatically adjusts for contours in the profile of the concrete slab that is being cut. It is yet another object to provide such an improved concrete cutter where the boom assembly also provides a primary structural support member for the chassis of the concrete cutter. It is still another object to provide such an improved concrete cutter having an optional vacuum system for the collection and accumulation of concrete-dust and contaminant slurry as a groove is being cut in the concrete slab.

The improved concrete cutter of the present invention has obtained these objects. It provides for a concrete cutter having a longitudinally-extending primary boom that allows one or more saw carriage sub-assemblies to move along the length of the boom, each carriage being effectively "captured" by a plate assembly that is attachable to the underside of the boom. The plate assembly is continued with "wing-like" boom extensions that are hingedly integrated and secured at each end of the primary boom. In this way, the boom extensions can be easily and reliably positioned at each end of the primary boom when such is desired or required by the operator to extend the cutting width of the concrete cutter and without requiring that the boom extensions be removed from the concrete cutter. This configuration also allows the saw carriage sub-assemblies to be moved along the boom extensions and the boom extensions then moved upwardly and out of the way from the primary boom during transport of the concrete cutter. This configuration is also a benefit when maintenance of the carriage sub-assemblies is require, the placement of the carriage sub-assemblies along the boom extensions allowing the carriage sub-assemblies being raised to a position where work on them is more convenient to the user, including occasions when the blades must be replaced, for example.

The improved concrete cutter of the present invention has a boom and saw carriage sub-assembly where saw carriage alignment and spacing is variably-adjustable along the boom. This is accomplished by providing a drive means with the boom along which each saw carriage can be independently placed such that each saw carriage can move toward or away from the other saw carriage as is desired or required by the operator. Each saw carriage sub-assembly is height-variable such that each is self-adjusting to contours in the profile of the concrete slab that is being cut, independently of the other carriage sub-assembly. This self-adjusting feature also relieves stress along the boom which prevents the boom from potential deformation or cracking.

The foregoing and other features of the improved concrete cutter of the present invention will be apparent from the detailed description that follows.

DETAILED DESCRIPTION OF THE PREFERRED EMBODIMENT

Figure 1:
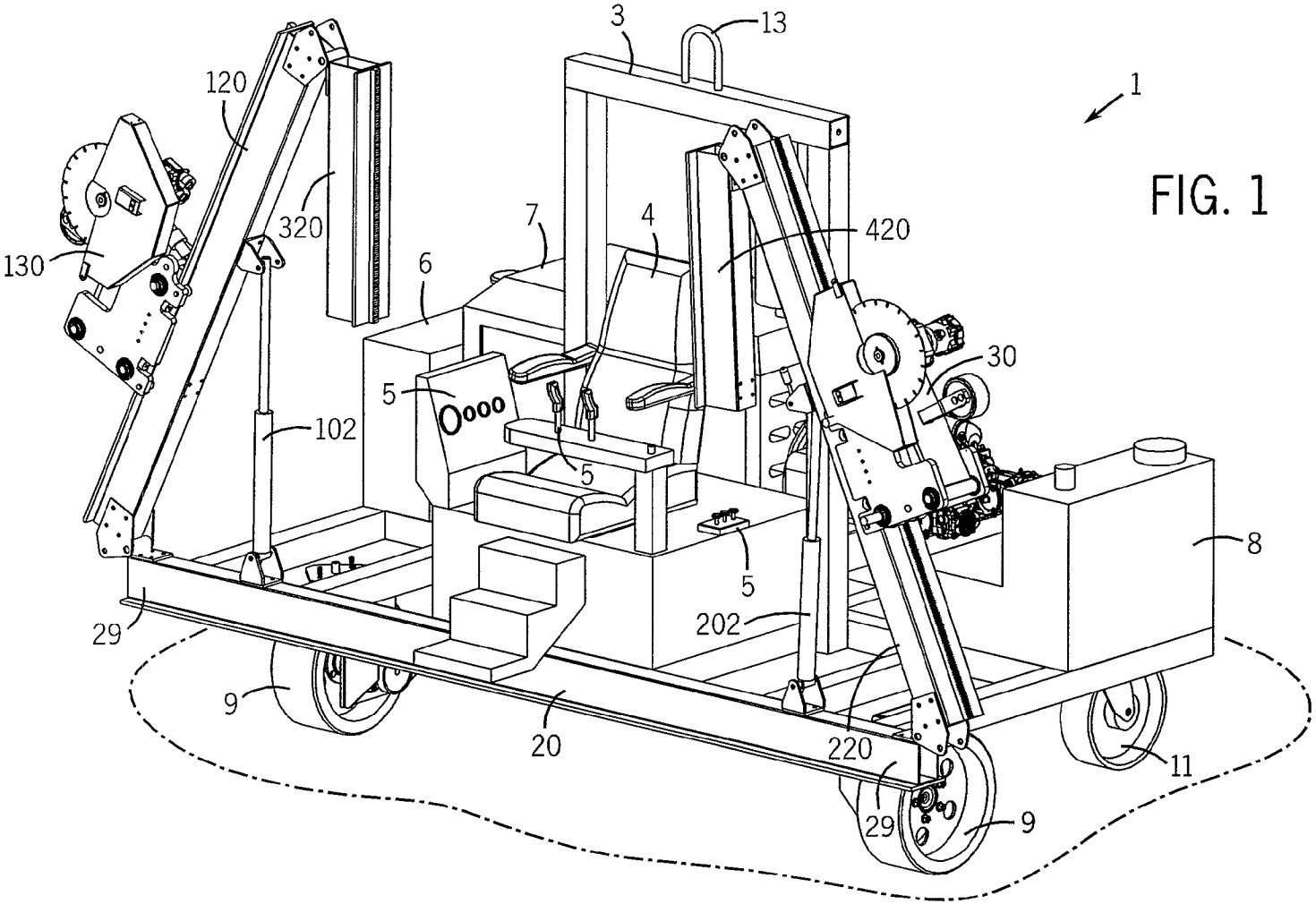
FIG. 1 is a front, top and right side perspective view of a preferred embodiment of the improved concrete cutter constructed in accordance with the present invention and showing the boom extensions and carriage sub-assemblies in the "up" or "non-cutting" positions.

Referring now to the drawings in detail, wherein like numerals represent like structure and elements throughout, FIG. 1 illustrates a preferred embodiment of the improved concrete cutter of the present invention, generally identified 1. As shown, the improved concrete cutter 1 comprises a generally horizontally-disposed chassis 2, a forward-most portion of the chassis 2 being comprised of a primary boom 20. Extending upwardly from the chassis 2 is an upright frame support member 3, this upright member 3 including a lifting hook 13 that is provided for purposes of hoisting the concrete cutter 1 when such is desired or required, such as when loading the cutter 1 upon a trailer bed for transport.

Situated forwardly of the upright support member 3 is a seat 4 that is intended to be used by the operator of the cutter 1. Forwardly and to either side of the seat 4 are user controls 5 of conventional manufacture. The controls 5 may include, among other things, wheel drive levers, an instrumentation panel, down-force controls, carriage travel speed controls and down-force speed control means, although the precise type and location of controls used is not a limitation of the present invention.

Disposed rearwardly of the upright frame support member 3 is a fuel tank 6, a diesel engine 7 and a hydraulic fluid reservoir 8. As seen more clearly in FIG. 2, the diesel engine 7 is used to drive a hydraulic pump 18 that is used to pressurize hydraulic fluid (not shown) that is used to drive various blade drives, etc. that are used in the cutter 1 of the present invention and that will be discussed in more detail later in this detailed description. The hydraulic fluid is distributed to operate various hydraulic motors via multiple connected hoses (also not shown). Although these various members and items that sit atop of, and are shown in relative position to, the chassis 2, it is to be understood that these items could be moved elsewhere about the chassis 2 without limiting their performance and the location of each as disclosed herein is not a limitation of the present invention. The chassis 2 of the concrete cutter 1 is supported by a pair of forwardly disposed wheels 9, the wheels 9 also including wheel drive motors 19, and by a pair of rearwardly disposed casters 11.

As alluded to previously, the concrete cutter 1 comprises a transversely-disposed and longitudinally-extending primary boom 20, the boom 20 serving as the "carrier" for two saw carriage sub-assemblies 30, 130. The saw carriage sub-assemblies 30, 130 are identically configured, and are essentially "mirror images" of one another. The primary boom 20 is flanked by opposing, but similarly configured, secondary extension booms 120, 220 in somewhat of a "wing-like" fashion. These secondary extension booms 120, 220 are further flanked by opposing, and similarly configured, tertiary extension booms 320, 420, respectively, which are also configured in a "wing-like" fashion. The use of the secondary extension booms 120, 220 and the tertiary extension booms 320, 420 in conjunction with the primary boom 20 will be discussed in greater detail later in this detailed description. For the time being, it is to be understood that the cross-sectional profile of each boom 20, 120, 220, 320, 420 is identical. See FIG. 4, in particular, relative to this cross-sectional profile, as shown relative to extension boom 220.

Figure 3:
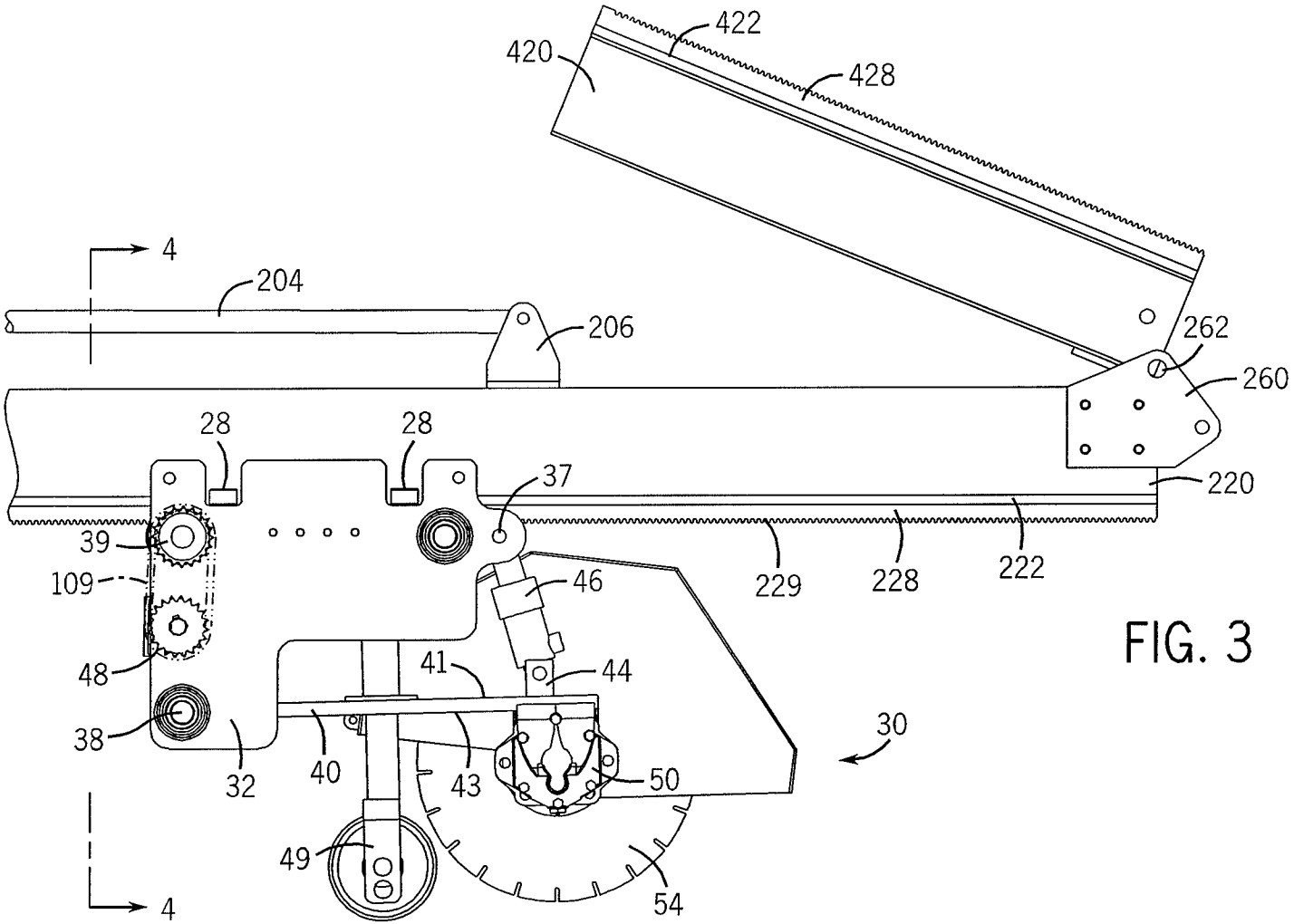
FIG. 3 is an enlarged front elevational view of the right-sided portion of the boom and carriage sub-assembly of the improved concrete cutter that is shown in FIGS. 1 and 2.
Figure 4:
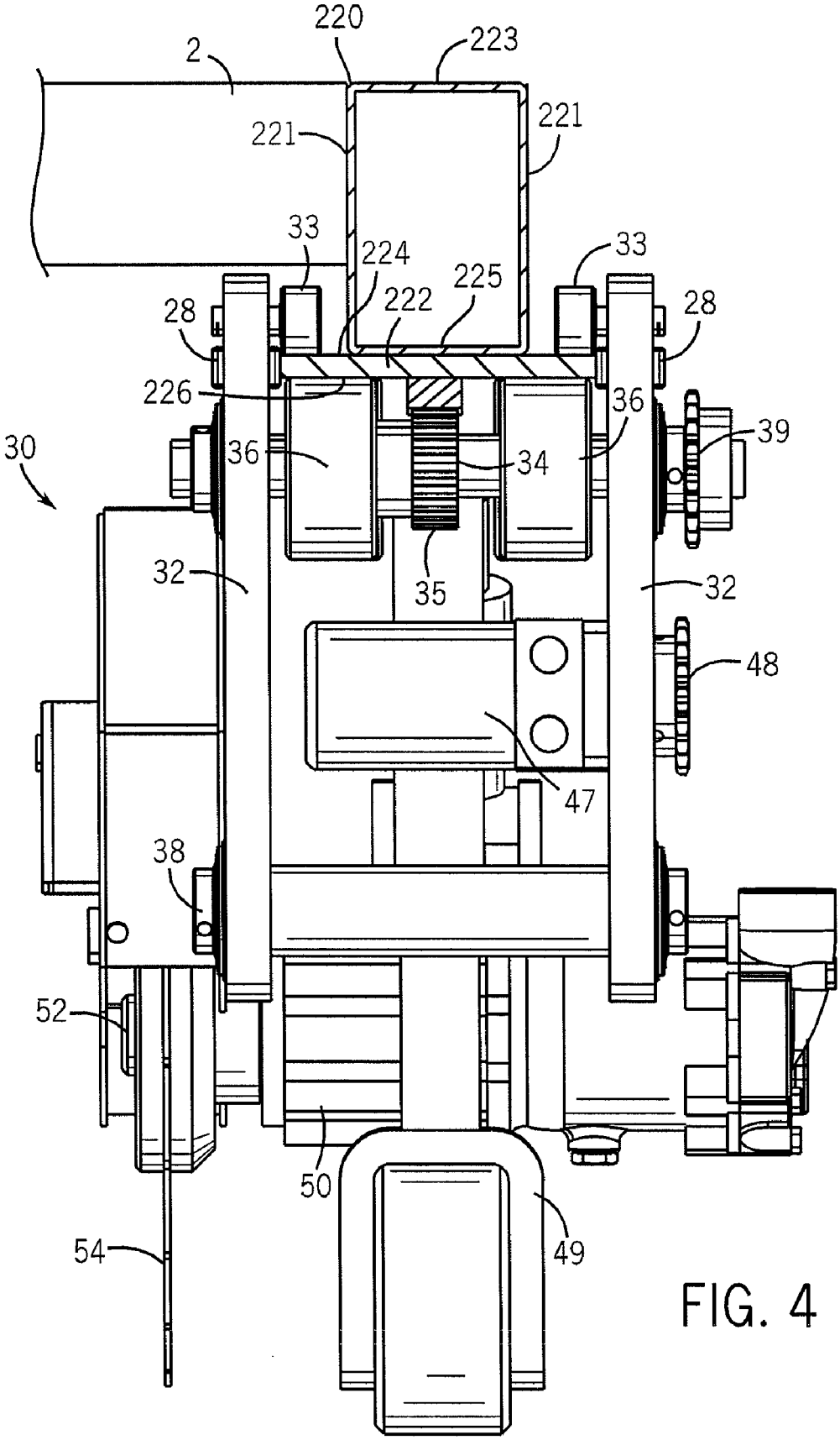
FIG. 4 is a further enlarged left side and partially-sectioned elevational view taken along line 4-4 of FIG. 3 and illustrating the details of the carriage sub-assembly that is movable along the boom extension shown.

As shown in FIG. 4, it will be seen that the extension boom 220 has two opposing vertical sides 221. The boom 220 further has a top surface 223 and a bottom surface 225. Again, it is to be understood that the cross-sectional profile of this boom 220 is representative of the other booms 20, 120, 320, 420. Secured to the bottom surface 225 of the boom 220 is a longitudinally-extending plate 222, the plate 222 being substantially wider than the boom 220. The plate 222 includes a top plate surface 224 and a bottom plate surface 226. Attached to the bottom surface 226 of the plate 222, and centered with respect to it, is a gear rack 228, the gear rack 228 including gear teeth 229 as are shown in FIG. 3.

Figure 5:
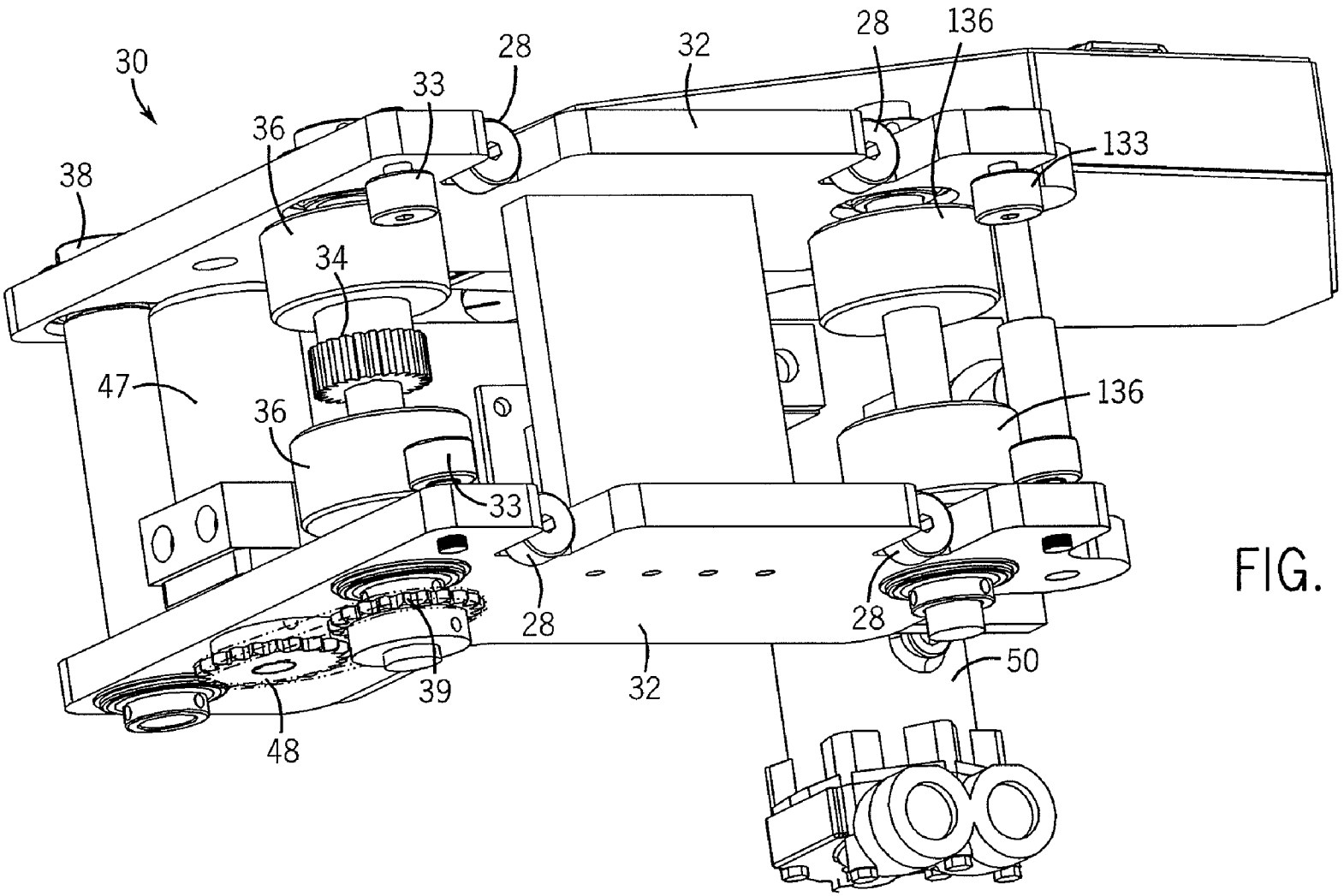
FIG. 5 is a top, front and left side perspective view of the carriage sub-assembly shown in FIG. 4.

The teeth 229 of the gear rack 228 are configured to meshingly engage the teeth 35 of a pinion gear 34 that is disposed between a pair of bottom wheel rollers 36, the rollers 36 extending between and being supported by opposing plates 32. See FIG. 4. It will also be seen in FIG. 4 that the plate 222 is captured between the bottom wheel rollers 36 and the top cam followers 33 that are built within the carriage sub-assembly 30. That is, the bottom wheel rollers 36 are disposed immediately adjacent the bottom surface 226 of the plate 222 and the top cam followers 33 are disposed immediately adjacent the top surface 224 of the plate 222. In this fashion, the carriage sub-assembly 30 can move longitudinally along the plate 222 by use of the gear teeth 229 when the hydraulic pinion drive motor 47 is actuated, the hydraulic pinion drive motor 47 including a sprocket 48 that drives a similar sprocket 39 by means of a chain 109 (shown in phantom view in FIGS. 3 and 5) that mechanically links the sprockets 39, 48 to one another. Referring specifically to FIG. 5, it will be seen that another pair of bottom wheel rollers 136 and top cam followers 133 are also built into the carriage sub-assembly 30 for capturing the plate 222 therebetween as well. A number of side cam followers 28 are mounted to each plate 32 to ensure that the longitudinal alignment of the carriage sub-assembly 30 is maintained during use.

Figure 2:
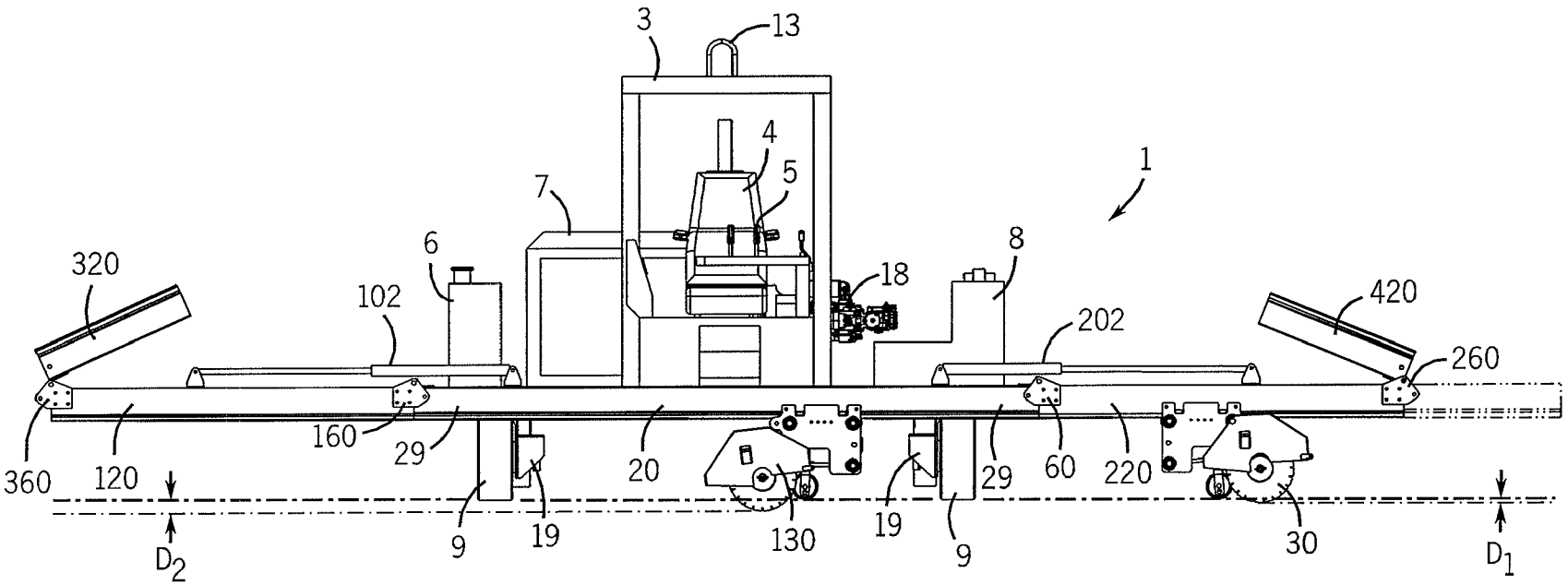
FIG. 2 is a front elevational view of the improved concrete cutter shown in FIG. 1 and showing the boom extensions and the carriage sub-assemblies each moved to the "down" or "cutting" positions.

Referring back to FIG. 3, it will be seen that each side plate 232 is a generally L-shaped plate, but such is not a limitation of the present invention. The side plates 32 may be alternatively shaped as long as such shape does not interfere with the movement of other elements that must interact with the plates 32. It will also be seen in FIG. 4 that a pivot pin 38 extends between the opposing plates 32 and below the boom 220. Referring back to FIG. 3, it will be seen that a motor mount plate 40 is attached to the pivot pin 38 such that the plate 40 can rotate upwardly and downwardly at the pivot pin 38. The motor mount plate 40 includes a top side 41 that is configured with a ram bracket 44. A ram 46 is interposed between the ram bracket 44 and a ram pin 37 that extends between the side plates 32, the ram pin 37 also being disposed below the boom 220. The bottom side 43 of the motor mount plate 40 has a hydraulic blade motor 50 mounted to it, the motor 50 having a motor shaft 52 which rotatingly drives an attached concrete saw blade 54, the saw blade 54 being in direct contact with a concrete surface (not shown) during normal operation of the device. In the preferred embodiment, the motor 50 is hydraulically-driven, but such is not a limitation of the present invention. Also in the preferred embodiment, the saw blade 54 is a diamond blade having a diameter of between 14 to 20 inches (14-20"). The motor mount plate 40 also includes a profile wheel assembly 49 that is vertically adjustable to allow for cutting depth adjustment for the saw blade 54. As illustrated in FIG. 2, the depth of cuts can be independently and variably adjusted by means of the profile wheel assembly 49, as shown by $D_1$, $D_2$ in that figure.

Referring again to FIG. 1, it will be seen that the primary boom 20 has opposing ends 29. Each end 29 is configured to receive a pair of end plates 60, 160. In the preferred embodiment, each secondary boom 120, 220 is hingedly attached to the end plates 60, 160. As will be seen more clearly in FIG. 3, it will be seen, for example, that the tertiary plate 420 is rotatably attached to the secondary boom 220 by means of end plates 260. The same configuration is used to connect the other booms to one another. It will also be seen in FIG. 3 that the top surface 223 of the secondary boom 220 includes an anchor bracket 206 to which is attached the piston rod 204 of the hydraulic piston 202. The piston cylinder 203 is similarly attached to the primary boom 20 by means of an anchor bracket 208. See FIG. 1. Actuation of the hydraulic piston 202 allows the secondary boom 220 to be lowered and placed into linear alignment with the primary boom 20 as is shown in FIG. 2.

In application, the improved concrete cutter of the present invention has a boom 20 and saw carriage sub-assemblies 30, 130 where saw blade 54 alignment and spacing is variably-adjustable along the boom 20. This is accomplished by actuating the hydraulic pinion drive motor 47 such that each saw carriage sub-assembly 30, 130 can move toward or away from the other saw carriage sub-assembly 30, 130 as is desired or required by the operator. In the preferred embodiment, hydraulic actuation of the pinion drive motor 47 allows the gear teeth 35 of the pinion gear 34 to move along the gear teeth 229 of the gear rack 228. Additionally, each saw carriage sub-assembly 30, 130 is functionally adapted to be selectively placed at any point along the gear rack 228, 428 such that each saw carriage sub-assembly 30, 130 can be located to commence movement from a given point along the boom 20, depending upon the requirements of each individual project. Although not shown, the motor 50 may be mounted to the plate 40 in such a way that the motor 50 and blade 54 are rotatable about the plate 40. In this fashion, the blade 54 can be re-positioned, for example, at a 90° angle relative to its position as shown in the drawings. This positioning allows for centerline cutting by the blade 54 as well as transverse joint cutting. This provides the concrete cutter of the present invention with even greater versatility in use for a wide range of applications.

In application, it will also be appreciated to those skilled in the art that each saw carriage sub-assembly 30, 130 is height-variable by virtue of the operation of the profile wheel 49 and ram 46, each being self-adjusting to contours in the profile of the concrete slab that is being cut, independently of the other saw carriage sub-assembly 30, 130. This feature is further provided by use of the hinged motor mount plate 40 that is disposed at the bottom-most portion of each saw carriage sub-assembly 30, 130 in conjunction with the ram 46. In this fashion, the saw blade 54 itself is effectively variably adjustable with respect to the depth of cut to be made.

As alluded to earlier, the improved cutter 1 comprises a longitudinally-extending primary boom 20, the boom 20 serving as the "carrier" for the two saw carriage sub-assemblies 30, 130. The primary boom 20 is flanked by opposing, but similarly configured, secondary booms 120, 220 in a "wing-like" fashion. The use of the secondary booms 120, 220 with the primary boom 20 is accomplished by a lowering of the secondary booms 120, 220 such that all three of the booms 20, 120, 220 provide a longitudinally-extending continuum along which the two saw carriage sub-assemblies 30, 130 may travel during use. This accomplishes the purpose of providing a substantially greater width of operation for the two saw carriage sub-assemblies 30, 130. The secondary booms 120, 220 are movable upwardly and downwardly by means of the hydraulic lift cylinders 102, 202. In this fashion, the booms 120, 220 are freely movable as desired or required by the operator.

As an alternative embodiment of the improved concrete cutter of the present invention, the cutter may be outfitted with a vacuum means (not shown) for collecting the slurry that is created by concrete dust and saw blade 54 residue that is the expected result of the concrete cutting process. In the improved concrete cutter, the vacuum means is a device that is attachable to the framework of the device with one or more hoses or other conduit-like members extending from the vacuum means to the area of each cutting blade 54, the hoses being movable with the cutting blade 54. In this fashion, the slurry is drawn by vacuum into the hoses and routed to a collection means, such as a vacuum canister-like structure, for later disposal of the slurry. In this way, any potentially hazardous by-products of the cutting blade 54 are collected and not allowed to contaminate the environment which they would otherwise do as part of the concrete dust that is created during the cutting process.

Accordingly, it will be seen that there has been provided a new and useful improved concrete cutter that has a boom and saw carriage assembly where boom extensions are integrated with the primary boom and available for use when such is desired or required by the operator; where saw carriage alignment and spacing is variably-adjustable along the boom; where the boom and saw carriage assembly is height-variable for each saw carriage; where each saw carriage is independent of the other saw carriage, or carriages, used in the assembly such that the assembly automatically adjusts for contours in the profile of the concrete slab that is being cut; and where the improved concrete cutter has an optional vacuum system for the collection and accumulation of concrete-dust and contaminant slurry as a groove is being cut in the concrete slab.

The principles of the present invention having been presented in accordance with the foregoing, we claim:

1. An improved concrete cutter comprising a chassis that is movable;

an operator seat mounted to the chassis;

operator control means located on the chassis, such control means being operable to move the chassis in a first direction along a surface to be cut;

a primary boom attached to the moving chassis, the primary boom being attached to the chassis such that the primary boom is generally perpendicular to the first direction;

a first secondary boom, the first secondary boom being attached to the primary boom by a first secondary boom hinge, the first secondary boom hinge being operable to permit the secondary boom to align with the primary boom;

a second secondary boom, the second secondary boom being attached to the primary boom by a second secondary boom hinge, the second secondary boom hinge being operable to permit the secondary boom to align with the primary boom;

means for placing said secondary booms in longitudinal alignment with said primary boom and for retracting said secondary booms from longitudinal alignment with said primary boom;

at least one concrete cutting sub-assembly attached to the primary boom or one of the secondary booms, the at least one concrete cutting sub-assembly comprising:

a side plate;

a motor mount plate having a first end that is pivotally mounted to the side plate and a second end;

a saw motor attached to the second end of the motor mount plate, the saw motor being operable to drive a motor shaft and a saw;

a profile wheel assembly attached to the motor mount plate between the first end of the motor mount plate and the second end of the motor mount plate, the profile wheel assembly being adjustable to permit adjustment of the cutting depth of the saw;

a ram attached to the motor mount plate, the ram being operable to maintain pressure on the profile wheel assembly such that the profile wheel assembly maintains contact with the surface to be cut; and means for moving the at least one concrete-cutting sub-assembly along the primary boom and along the secondary booms in a second direction that is generally perpendicular to the first direction.

2. The improved concrete cutter of claim 1 further comprising a first tertiary boom connected to the first secondary boom by a hinge and a second tertiary boom connected to the second secondary boom by a hinge for placing said tertiary booms in longitudinal alignment with said pair of secondary booms and said primary boom.

3. The improved concrete cutter of claim 1 wherein the control means comprises means for controlling the longitudinal movement of the at least one concrete cutting sub-assembly along the primary boom, the first secondary boom and the second secondary boom.

4. An improved concrete cutter comprising:

a chassis that is selectively movable in a first direction along a concrete cuffing surface;

an operator seat attached to the chassis;

an operator control means located on the chassis, such control means being used by the operator to selectively move the chassis along a surface to be cut;

a primary boom attached to the moving chassis, the primary boom being attached to the chassis such that the primary boom is generally perpendicular to the first direction;

a first secondary boom, the first secondary boom being attached to the primary boom by a first secondary boom hinge, the first secondary boom hinge being operable to permit the secondary boom to align with the primary boom;

a second secondary boom, the second secondary boom being attached to the primary boom by a second secondary boom hinge, the second secondary boom hinge being operable to permit the secondary boom to align with the primary boom; means for placing said secondary booms in longitudinal alignment with said primary boom and for retracting said secondary booms from longitudinal alignment with said primary boom;

a first tertiary boom attached to the first secondary boom by a first tertiary hinge;

a second tertiary boom attached to the second secondary boom by a second tertiary hinge;

means for placing said first and second tertiary booms in longitudinal alignment with said secondary booms and said primary boom and for retracting said tertiary booms for storage;

a pair of concrete cutting sub-assemblies attached to one of the primary, secondary or tertiary booms, each concrete cutting sub-assembly comprising:

a side plate;

a motor mount plate having a first end pivotally mounted to the side plate and a second end;

a saw motor attached to the second end of the motor mount plate, the saw motor being operable to drive a motor shaft and a saw;

a profile wheel assembly attached to the motor mount plate between the first end of the motor mount plate and the second end of the motor mount plate, the profile wheel assembly being adjustable to permit adjustment of the cutting depth of the saw;

a ram attached to the motor mount plate, the ram being operable to maintain pressure on the profile wheel assembly such that the profile wheel assembly maintains contact with the surface to be cut; and means for selectively moving the pair of concrete-cutting sub-assemblies along the primary boom, the secondary booms and the tertiary booms in a second direction that is generally perpendicular to the first direction.

5. The improved concrete cutter of claim 4 wherein the control means comprises means for selectively controlling the longitudinal movement of the concrete cutting sub-assemblies along the primary boom, the secondary booms and the tertiary booms.

6. The improved concrete cutter of claim 5 wherein the control means further comprises means for independently controlling the longitudinal movement of each concrete cutting sub-assembly.

* * * * *

UNITED STATES PATENT AND TRADEMARK OFFICE

CERTIFICATE OF CORRECTION

PATENT NO. : 7,451,757 B2
APPLICATION NO. : 11/682453
DATED : November 18, 2008
INVENTOR(S) : Ketterhagen et al.

It is certified that error appears in the above-identified patent and that said Letters Patent is hereby corrected as shown below:

At Col. 9, line 6 the word "cuffing" should be replaced with the word "cutting."

Signed and Sealed this

Thirtieth Day of December, 2008

JON W. DUDAS
*Director of the United States Patent and Trademark Office*